US009230752B2

(12) United States Patent
Lee

(10) Patent No.: US 9,230,752 B2
(45) Date of Patent: Jan. 5, 2016

(54) SEAT SWITCH ASSEMBLY

(71) Applicant: Control & Measurement Systems Co., Ltd, Busan (KR)

(72) Inventor: Hyo-Moon Lee, Busan (KR)

(73) Assignee: CONTROL & MEASUREMENT SYSTEMS CO., LTD, Busan (KR)

( * ) Notice: Subject to any disclaimer, the term of this patent is extended or adjusted under 35 U.S.C. 154(b) by 326 days.

(21) Appl. No.: 13/958,997

(22) Filed: Aug. 5, 2013

(65) Prior Publication Data

US 2014/0034462 A1 Feb. 6, 2014

(30) Foreign Application Priority Data

Aug. 3, 2012 (KR) ..... 10-2012-0085182

(51) Int. Cl.
*H01H 13/18* (2006.01)
*H01H 1/44* (2006.01)
*H01H 13/16* (2006.01)

(52) U.S. Cl.
CPC ..... *H01H 13/16* (2013.01); *H01H 1/44* (2013.01); *H01H 13/18* (2013.01)

(58) Field of Classification Search
CPC ..... H01H 13/16; H01H 13/18; H01H 13/30; H01H 13/36; H01H 1/44
See application file for complete search history.

(56) References Cited

U.S. PATENT DOCUMENTS 5,221,816 A * 6/1993 Williams ..... 200/531
6,483,061 B1 * 11/2002 Harvey et al. ..... 200/532

* cited by examiner

*Primary Examiner* — Amy Cohen Johnson
*Assistant Examiner* — Marina Fishman
(74) *Attorney, Agent, or Firm* — Lex IP Meister, PLLC

(57) ABSTRACT

A seat switch assembly can maintain a reliable switching operation due to enhanced durability. A pressing plate has guides which are fastened to guide holes of a base. A seat switch housing is fastened to an assembly hole of the base. An actuation rod is received inside a through-hole of the seat switch housing, and moves in the top-bottom direction in response to a pressure from the pressing plate. A V-shaped contact pin is fixed to a fixing guide of the actuation rod. One portion of a terminal pin is buried inside the seat switch housing, and the other portion of the terminal pin is exposed to the outside. A return spring is received in the lower portion of the actuation rod. A cover closes the lower portion of the through-hole. The inner surfaces of the through-hole and the terminal pin are coplanar without a stepped portion.

10 Claims, 7 Drawing Sheets

SEAT SWITCH ASSEMBLY

BACKGROUND OF THE INVENTION

1. Field of the Invention

The present invention relates to a seat switch assembly, and more particularly, to a seat switch assembly which has enhanced durability and which is applied to a seat warmer, an unattended start device, or the like of a vehicle.

2. Description of the Related Art

Vehicles are required to not only function as a transport means but also function as a means for providing a variety of conveniences such as a reliable and convenient driving environment for a driver or the like and also function safely to prevent unattended starts. The safety function is added to an ignition switch of a vehicle in order to allow a driving force from engine to be transmitted to an axle only after a driver has occupied the driver's seat. Therefore, vehicles are provided with a variety of convenience devices and safety devices and a variety of switches for operating and controlling them.

In the case of an apparatus which is typically required to operate in both directions, for example, a window of a vehicle, a see-saw switch or a sliding switch, which responds to the operation of the front end and the rear end of the window when the window moves in the top-bottom direction, is used. In particular, since a variety of switches and convenience devices are disposed around the driver's seat, the switches are required to have closely-related structures, and it is an essential requirement to prevent the switches from interfering with each other.

A seat switch for controlling the supply of power to hot wires provided in the vehicle seat or a push type tact switch which is manipulated by only the driver's occupation of the seat even if the driver directly manipulates it is used. Since the push type tact switch is disposed in the lower portion of the seat and the weight of the driver is repeatedly applied, it must have high durability.

Related-art techniques including multistage push button switches, seat warmer switches, return switches, switch devices and the like are disclosed in Korean Patent No. 10-0774715 (Nov. 8, 2007), Korean Laid-Open Utility Model No. 20-2010-0006924 (Jul. 8, 2010), Korean Laid-Open Patent Publication No. 10-2010-0103063 (Sep. 27, 2010) and Korean Patent No. 10-1099067 (Dec. 26, 2011) which were previously filed and were already published or patented.

Here, according to "MULTISTAGE PUSH BUTTON SWITCH FOR VEHICLE SEAT WARMER" in Korean Patent No. 10-0774715 (Nov. 8, 2007), whenever a push operation part 10 is pushed, a rotating part 40 rotates a certain angle so that switch terminals S3 and S4 of the rotating part 40 are sequentially connected to a seat cushion hot wire terminal S5, a thermostat terminal S6 and an off terminal S7 of an output 20.

In addition, according to "SEAT WARMER SWITCH FOR VEHICLE" in Korean Laid-Open Utility Model No. 20-2010-0006924 (Jul. 8, 2010), a switch slider 230 moves in the top-bottom direction together with a switch knob 210 so that a slider fixing terminal 420 and a slider movable terminal 410 are connected to each other.

Furthermore, according to "RETURN SWITCH FOR VEHICLE" in Korean Laid-Open Patent Publication No. 10-2010-0103063 (Sep. 27, 2010), two contact balls 32 which are elastically supported on a contact point spring 34 move in the top-bottom direction together with a pressing portion 20 so as to be connected to a contact portion 40.

In addition, according to "PUSH OPERATING SWITCH DEVICE" in Korean Patent No. 10-1099067 (Dec. 26, 2011), a driving protrusion 9 moves downward together with a manipulation member 7 to press an inversion spring 8 so that a central fixed contact 11 to which two terminals 13 are connected is connected to a peripheral fixed contact 12.

However, the related-art techniques as described above have the following problems: There is a danger of defective connection when the switch terminal, the seat cushion hot wire terminal, the thermostat terminal and the off terminal are abraded due to repeated rotation of the rotating part. Defective connection may occur due to the decreased elasticity when the coil spring which pushes the slider movable terminal which adjoins to the slider fixed terminal is used for a long time. Defective connection may occur due to the decreased elasticity when the contact point spring which pushes the two contact balls which adjoin to the ground portion is used for a long time. In the case of the inversion spring, since the inversion spring is constructed of a thin plate into the shape of a dome, it does not properly act when used repeatedly for a long time.

The information disclosed in the Background of the Invention section is only for the enhancement of understanding of the background of the invention, and should not be taken as an acknowledgment or any form of suggestion that this information forms a prior art that would already be known to a person skilled in the art.

RELATED ART DOCUMENT

Patent Document 1: Korean Patent No. 10-0774715 (Nov. 8, 2007)

Patent Document 2: Korean Laid-Open Utility Model No. 20-2010-0006924 (Jul. 8, 2010)

Patent Document 3: Korean Laid-Open Patent Publication No. 10-2010-0103063 (Sep. 27, 2010)

Patent Document 4: Korean Patent No. 10-1099067 (Dec. 26, 2011)

SUMMARY OF THE INVENTION

Accordingly, the present invention has been made keeping in mind the above problems occurring in the related art, and the present invention is intended to propose a seat switch assembly which can maintain a reliable switching operation due to the enhanced durability of a seat switch.

In order to achieve the above object, according to one aspect of the present invention, there is provided a seat switch assembly that includes a pressing plate which has a plurality of guides in the periphery thereof; a base having an assembly hole in the central portion thereof and a plurality of guide holes to which the plurality of guides are fastened; a seat switch housing which is fastened to the assembly hole of the base and has a through-hole extending in the top-bottom direction; an actuation rod which is received inside the through-hole of the switch housing, and moves in the top-bottom direction in response to a pressure transmitted from the pressing plate; a V-shaped contact pin which is fixed to a fixing guide of a fixing portion of the actuation rod; a terminal pin, one portion of the terminal pin being buried inside the seat switch housing and the other portion of the terminal pin being exposed to the outside; a return spring which is received in the lower portion of the actuation rod inside the through-hole of the seat switch housing; and a cover which closes the lower portion of the through-hole of the seat switch housing. The inner surface of the through-hole of the seat switch housing and the inner surface of the terminal pin buried inside the seat switch housing are positioned coplanar without a stepped portion.

An anti-dislodgment protrusion for preventing the contact pin from being dislodged may be coupled to one end of the fixed guide.

An upper guide may be formed on a fixing portion of the actuation rod, the upper guide maintaining elasticity of the contact pin by limiting the range to which the contact pin is shrunk inward.

Side guides may be formed on a fixing portion of the actuation rod, the side guides being positioned on both sides of the fixing guide to limit the range to which the contact pin is spread outward.

A lower guide may be formed on a fixing portion of the actuation rod, the lower guide being posited in the lower portion of the fixing guide to fix the contact pin so that the contact pin is uplifted along with the actuation rod when the actuation rod moves upward.

The terminal pin may be machined from brass.

The composition of the brass may include, by weight percent, 0.3 to 0.5 of Mn, 0.6 to 0.8 of Si, 0.5 to 1.0 of Sn, 0.5 to 0.8 of Be, 38 to 40 of Zn, and the balance Cu.

The contact pin is machined from phosphor bronze.

The composition of the phosphor bronze may include, by weight percent, 5.0 to 9.0 of Sn, 0.1 to 0.5 of P, 0.001 to 0.1 of Ce, 0.001 to 0.1 of La, and the balance Cu.

The terminal pin and the contact pin may have a difference in Vickers hardness of about 40 to 45.

The hardness of the terminal pin may range from 125 to 140 (Hv), and the hardness of the contact pin may range from 165 to 185 (Hv).

The seat switch assembly may further include a cover that closes the lower portion of the through-hole of the seat switch housing.

According to the seat switch assembly according to the present invention as set forth above, the stepped portion between the contact pin and the seat switch housing is omitted and the material qualities of the contact pin and the terminal pin are improved. Therefore, it is possible to increase the durability of the seat switch and maintain the reliable switching operation of the seat switch.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
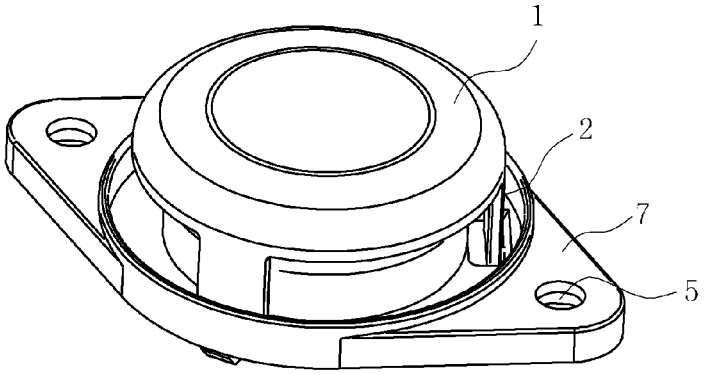
FIG. 1 is a perspective view showing a seat switch assembly of the present invention.

Reference will now be made in greater detail to a preferred embodiment of the present invention, an example of which is illustrated in the accompanying drawings. Wherever possible, the same reference numerals will be used throughout the drawings and the description to refer to the same or like parts.

Figure 2:
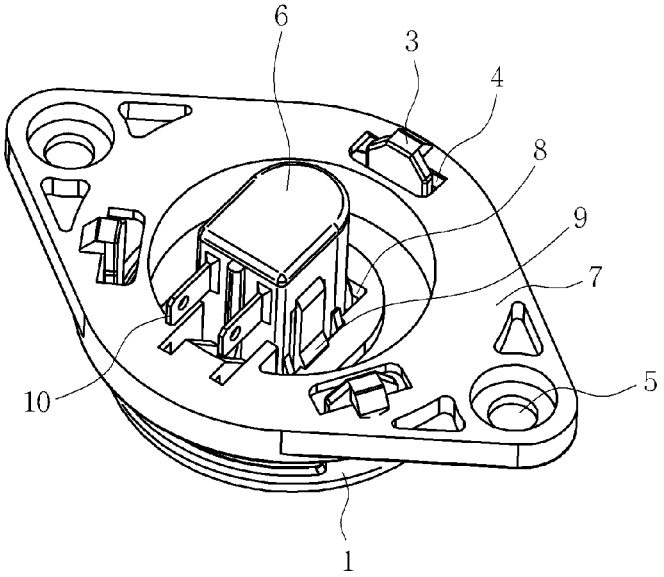
FIG. 2 is a bottom perspective view of the seat switch assembly shown in FIG. 1.

FIG. 1 is a perspective view showing a seat switch assembly of the present invention, and FIG. 2 is a bottom perspective view of the seat switch assembly shown of the present invention. As shown in the figures, the seat switch assembly of the present invention includes a base 7 which fixes a seat switch housing 6 to the lower portion of a seat, a pressing plate 1 which moves in the top-bottom direction in response to a pressure that is applied from above the seat, a seat switch housing 6 which has a terminal pin 10 and a contact pin 11 which are electrically switched "on/off" in connection with the pressing plate 1, and the like.

The base plate 7 is plate shaped, and is integrally assembled to the pressing plate 1 and the seat switch housing 6. The base 7 has an assembly hole 8 in the central portion thereof to which the seat switch housing 6 can be assembled and a plurality of guide holes 4 at predetermined distances from the assembly hole 8. Guides 2 of the pressing plate 1 can be fitted into the guide holes 4. A plurality of bolt holes 5 is formed on the outer circumference of the base 7. Bolts or the like can be fitted into the bolt holes 5 when fixing the seat switch assembly to the lower portion of the seat.

The pressing plate 1 moves in the top-bottom direction in response to a pressure applied from above the seat, and is molded such that it has a dome shape. The pressing plate 1 has a plurality of guides 2, which extend downward from the lower portion of the pressing plate 1 and are fitted into the guide holes 4 of the base 7.

Here, the guides 2 are molded from an elastic material, and are configured to spread outward in the direction toward the bottom. An anti-dislodgment protrusion is formed on the distal end of each guide 2 such that the guide 2 is not dislodged from the guide hole 4 when the pressing plate 1 moves in the top-bottom direction in the state where the guide 2 is coupled to the guide hole 4 of the base 7.

The seat switch housing 6 has the terminal pin 10 as a fixed contact and the contact pin 11 as a movable contact. The terminal pin 10 and the contact pin 11 are electrically switched "on/off" by the pressure applied from above the seat. The seat switch housing 6 has the terminal pin 10 that is made by insert injection molding. A portion of the terminal pin 10 is exposed into a through-hole of the seat switch housing 6, and the remaining portion of the terminal pin 10 is exposed to the outside. In addition, the seat switch housing 6 has fixing hooks 9 on both sides thereof, which serve to hold the seat switch housing 6 so as not to be dislodged by an external pressure applied thereto when the seat switch housing 6 is assembled to the assembly hole 8 of the base 7.

Figure 3:
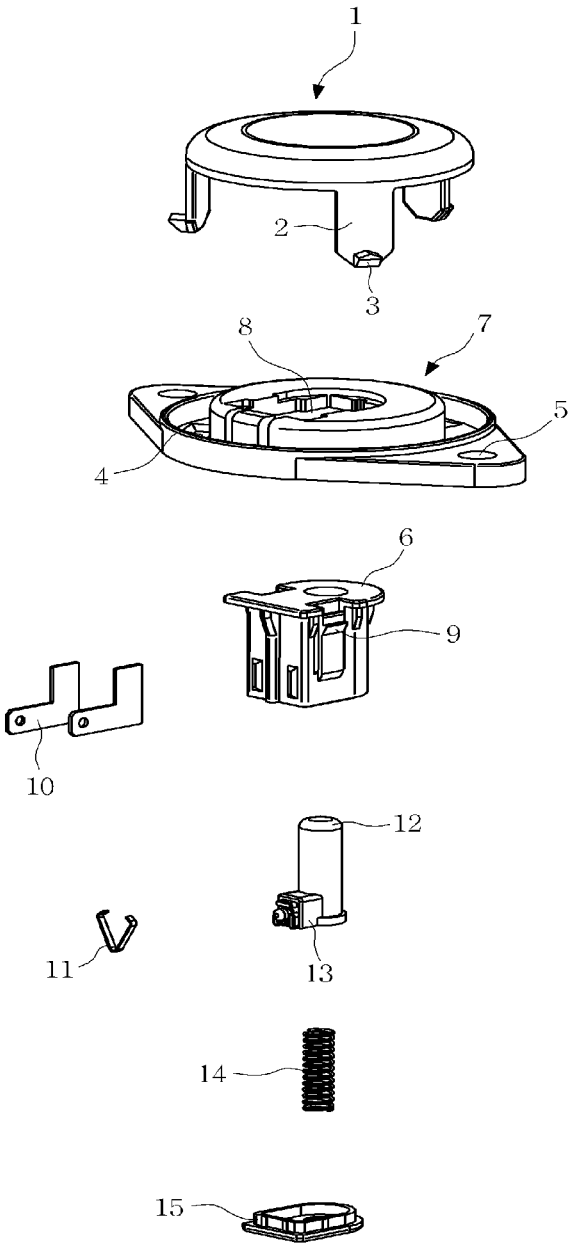
FIG. 3 is an exploded perspective view of the seat switch assembly according to the present invention.

FIG. 3 is an exploded perspective view of the seat switch assembly according to the present invention.

Referring to FIG. 3, the pressing plate 1 of the seat switch assembly directly contacts the lower portion of the seat or the like of the vehicle, and moves in the top-bottom direction in response to a pressure applied from above the seat. The pressing plate 1 is dome shaped.

The pressing plate 1 has a plurality of guides 2 which extend downward from the outer circumference of the lower portion. The guides 2 are coupled to the guide holes 4 of the base 7, and maintain the base 7 and the pressing plate 1 in the coupled state while guiding the pressing plate 1 which moves in the top-bottom direction.

Each guide 2 is molded from an elastic material such as plastic, and has the shape that spreads outward in the direction toward the bottom. An anti-dislodgment protrusion 3 is formed on the outer circumference of the distal end such that the guide 2 is not dislodged from the guide hole 4 when the pressing plate 1 moves in the top-bottom direction in the state where the guide 2 is coupled to the guide hole 4 of the base 7.

The base 7 having the pressing plate 1 on the upper portion thereof serves to fix the seat switch assembly to a specific position of the vehicle seat, in which the pressing plate 1 and the seat switch housing 6 are integrally assembled to each other.

The base 7 has the coupling hole 8 in the central portion to which the seat switch housing 6 is assembled. The plurality of guide holes 4 are formed around the assembly hole 8. The guides 2 of the pressing plate 1 can be fitted into the guide holes 4. The plurality of bolt holes 5 are formed on the outer circumference of the base 7. Bolts or the like can be fitted into the bolt holes 5 when fixing the seat switch assembly to the lower portion of the seat.

While the upper and lower surfaces of the base 7 can be molded to be flat, they can be molded into a shape that is suitable for coupling with the pressing plate 1 or the seat switch housing 6.

The seat switch housing 6 has the terminal pin 10 and the contact pin 11 which are switched "on/off" in response to the pressing plate 1 and an actuation rod 12 which move in the top-bottom direction in response to a pressure applied from above the seat.

The seat switch housing 6 has an upper flange 23 in the upper portion which supports the seat switch housing 6 so as not to slip downward when the seat switch housing 6 is coupled to coupling hole 8 of the base 7. In addition, the seat switch housing 6 has the fixing hooks 9 on both sides, which serve to hold the seat switch housing 6 so as not to be dislodged by an external pressure applied thereto when the seat switch housing 6 is assembled to the assembly hole 8 of the base 7. Of course, the fixing hooks 9 are molded from an elastic material, and are required to protrude beyond the both sides of the seat switch housing 6.

The terminal pin 10 is made of metal and serves as a fixed contact. The terminal pin 10 is integrally molded with the seat switch housing 6 such that a portion thereof is exposed to the outside. Since the inner surface 10*a* of the terminal pin 10 and the inner surface 6*a* of the through-hole 24 of the seat switch housing 6 are formed coplanar without a stepped portion, as shown in FIG. 5B and FIG. 6B, it is possible to minimize contact resistance to the contact pin 11 which moves in the top-bottom direction along the inner surface 6*a* of the through-hole 24 of the seat switch housing 6 and the inner surface 10*a* of the terminal pin 10.

In addition, the seat switch housing 6 includes therein the contact pin 11 made of metal, the actuation rod 12 and a return spring 14. The through-hole 24 extends in the top-bottom direction of the seat switch housing 6, and the cover 15 can be coupled to the through-hole 24. The uppermost portion of the through-hole 24 is stepped such that the inner diameter thereof is smaller than the outer diameter of a lower flange 25 on the lower end of the actuation rod 12 and greater than the outer diameter of the actuation rod 12.

Here, the lower flange 25 is formed on the lower end of the actuation rod 12 and the inner diameter of the uppermost portion of the through-hole 24 is stepped so as to be smaller than the inner diameter of the lower portion of the through-hole 24 in order to limit the uplift of the actuation rod 12 inside the through-hole 24.

Figure 4:
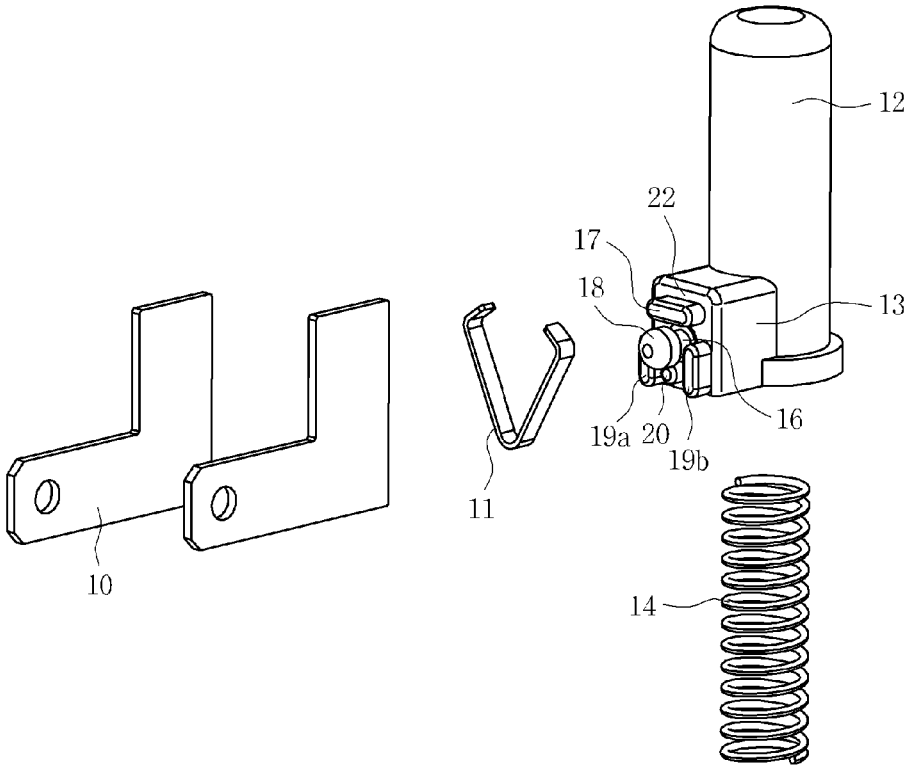
FIG. 4 is an enlarged perspective view of the seat switch shown in FIG. 3.

FIG. 4 is an enlarged perspective view of the seat switch shown in FIG. 3.

As shown in FIG. 4, the actuation rod 12 which moves in the top-bottom direction in connection with the pressing plate 1 is designed to the fitted into the through-hole 24 of the seat switch housing 6. The actuation rod 12 has a storage recess which is opened downward and the lower flange 24 on the lower end. As described above, the outer diameter of the lower flange 25 is greater than the inner diameter of the uppermost portion of the through-hole 24.

A fixing guide 16 is formed on the front surface 22 of the fixing portion 13 of the actuation rod 12, and serves to fix the contact pin 11 which is bent into the shape of a V. The contact pin 11 fixed to the fixing guide 16 is arranged in the shape of a V around the fixing guide 16. Of course, the contact pin 11 stays in contact with the inner surface 6*a* of the through-hole 24 or the inner surface 10*a* of the terminal pin 10 while moving in the top-bottom direction inside the through-hole 24. In particular, an anti-dislodgment cap 18 is fixed to one end of the fixing guide 16 by hot fusion, whereby the contact pin 11 is not dislodged from the fixing guide 16.

One end 21 of the contact pin 11 is bent inward in order to minimize frictional force during movement in the top-bottom direction.

In addition, an upper guide 17 is formed on the front surface above the fixed guide 17, and serves to limit the range to which the contact pin 11 is shrunk inward, thereby maintaining the elasticity of the contact pin. Side guides 19*a* and 19*b* are formed on both sides of the fixed guide 16, and serve to limit the range to which the contact pin 11 is spread outward. A lower guide 20 is formed below the fixed guide 16, and serves to fix the contact pin 11 so that the contact pin 11 moves upward together with the actuation rod 12 when the contact pin 11 is uplifted together with the actuation rod 12.

In this case, the terminal pin 10 is made of brass, and the contact pint 11 is made of phosphor bronze. The terminal pin 10 and the contact pin 11 have a difference in Vickers hardness ranging from 40 to 45, as presented in Table 1, in order to increase abrasion resistance.

TABLE 1

| Product name | | Terminal pin Brass | Contact pin Phosphor bronze |
|---|---|---|---|
| Chemical composition (wt %) | | Cu 56.9.0 to 60.1<br>Mn 0.3 to 0.5<br>Si 0.6 to 0.8<br>Sn 0.5 to 1.0<br>Be 0.5 to 0.8<br>Zn 38 to 40 | Sn 5.0 to 9.0<br>P 0.1 to 0.5<br>Ce 0.001 to 0.1<br>La 0.001 to 0.1<br>The balance Cu |
| Specific gravity (gm/cm$^3$) | | 8.47 | 8.8 |
| Thermal conductivity (Cal/cm/sec/° C.) | | — | 0.15 |
| Electric conductivity (% IACS, 20° C.) | | 28 MIN | 11 MIN |
| Tensile strength (Kgf/mm$^2$) | ½ H | 39 to 44 | 52 to 58 |
| Elongation | ½ H | 28 to 38 | 38 MIN |
| Vickers Hardness | ½ H | 125 to 140 | 165 to 185 |

When the content of tin (Sn) increases, hardness and elasticity increase but conductivity decreases. Therefore, the Sn content preferably ranges from 0.5 to 1.0 wt % for bronze and 5.0 to 9.0 wt % for phosphor bronze. In addition, phosphorus (P) is added for the purpose of deoxidization. It is preferred to increase electrical conductivity by adding 0.1 to 0.5 wt % of P so that substantially no oxide is produced in phosphor bronze.

In particular, when the hardness difference is 10 or less, abrasion is severe. When the hardness difference is 50 or more, slipping occurs. Therefore, it is preferred that the hardness difference range from 40 to 45.

The return spring 14 for restoring the actuation rod 12 and the pressing plate 1 which moved down to the original positions is provided in the storage recess of the actuation rod 12.

The lower portion of the through-hole 24 of the seat switch housing 6 in which the actuation rod 12, the return spring 14 and the like are disposed is closed by the cover 15. The cover 15 can be attached to the seat switch housing 6, for example, using an adhesive or by hot fusion.

Figure 5A:
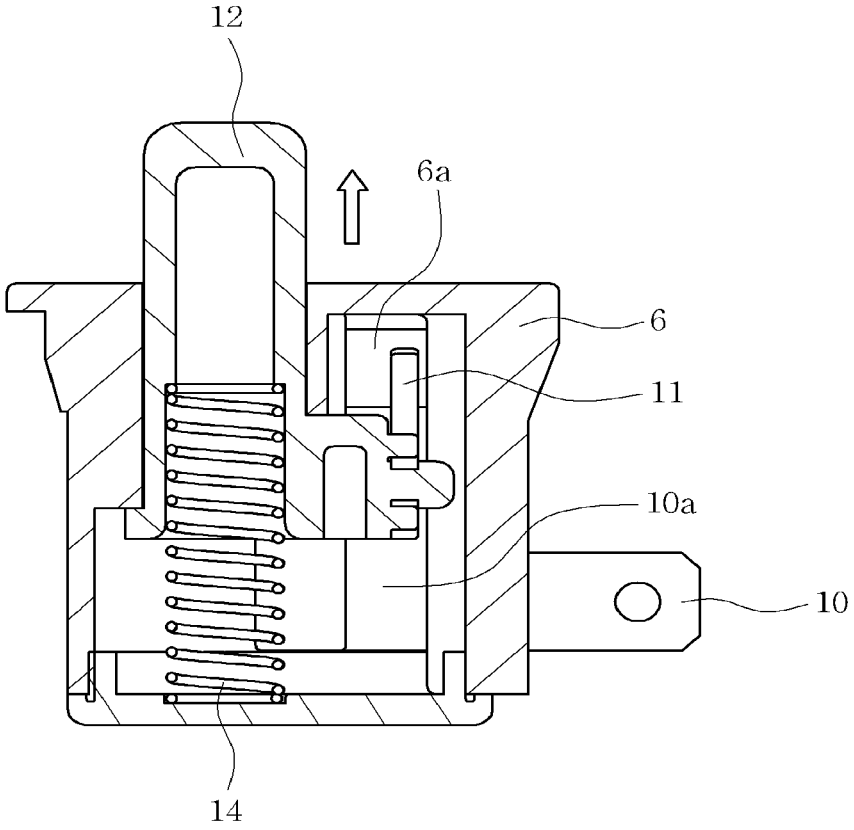
FIG. 5A and FIG. 5B are cross-sectional views showing the state in which the seat switch of the present invention has returned to the original position when pressure that was applied from above is removed.
Figure 5B:
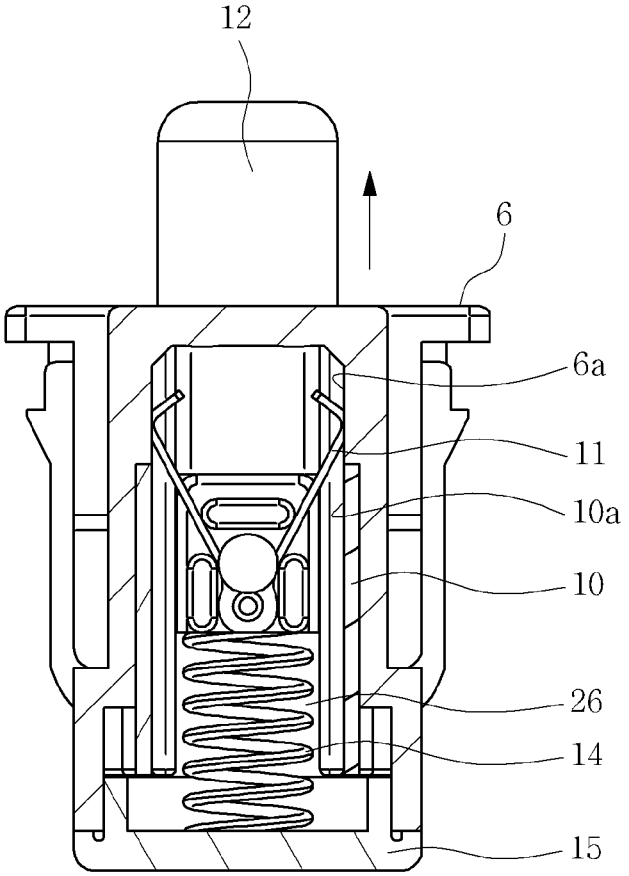

FIG. 5A and FIG. 5B are cross-sectional views showing the state in which the seat switch of the present invention has returned to the original position when pressure that was applied from above is removed.

Referring to FIG. 5A and FIG. 5B, when there is no occupant on the seat of the vehicle or an occupant who has occupied the seat gets off the seat, the seat switch stays in the "off" state in which the terminal pin 10 acting as the fixed contact and the contact pin 11 acting as the movable contact are electrically disconnected from each other.

In other words, since there is no pressure applied from above the actuation rod 12, the actuation rod 12 together with the contact pin 11 is uplifted by the elastic force of the return spring 14 so that the contact pin 11 connects to the inner surface 6*a* of the through-hole 24.

Figure 6A:
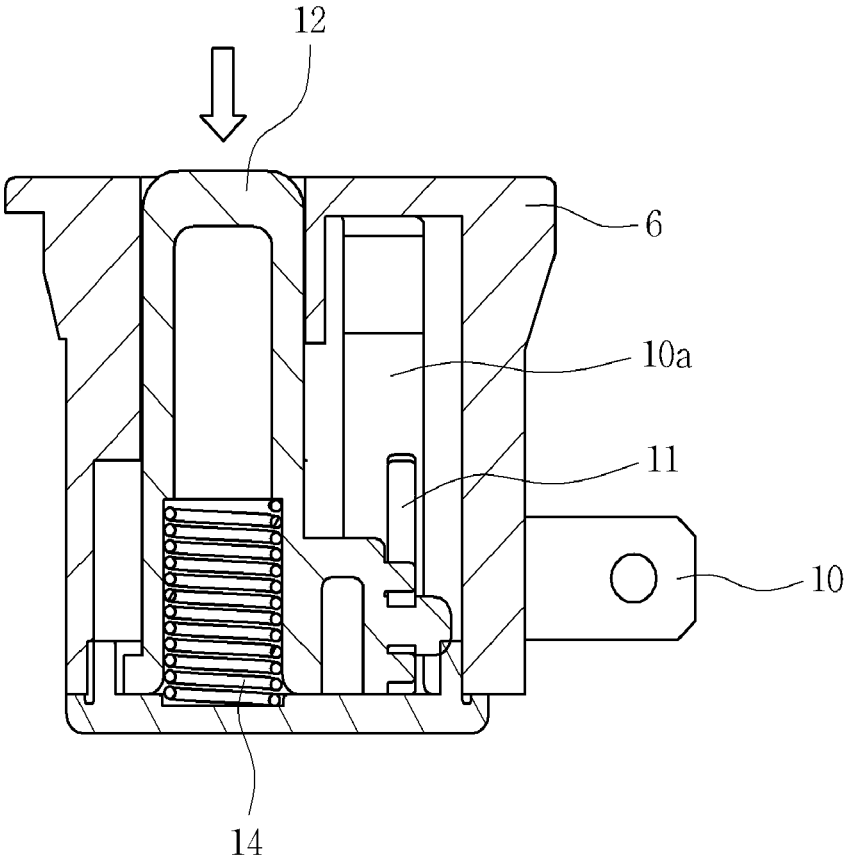
FIG. 6A and FIG. 6B are cross-sectional views showing the state in which the seat switch of the present invention is operated when a pressure is applied from above.
Figure 6B:
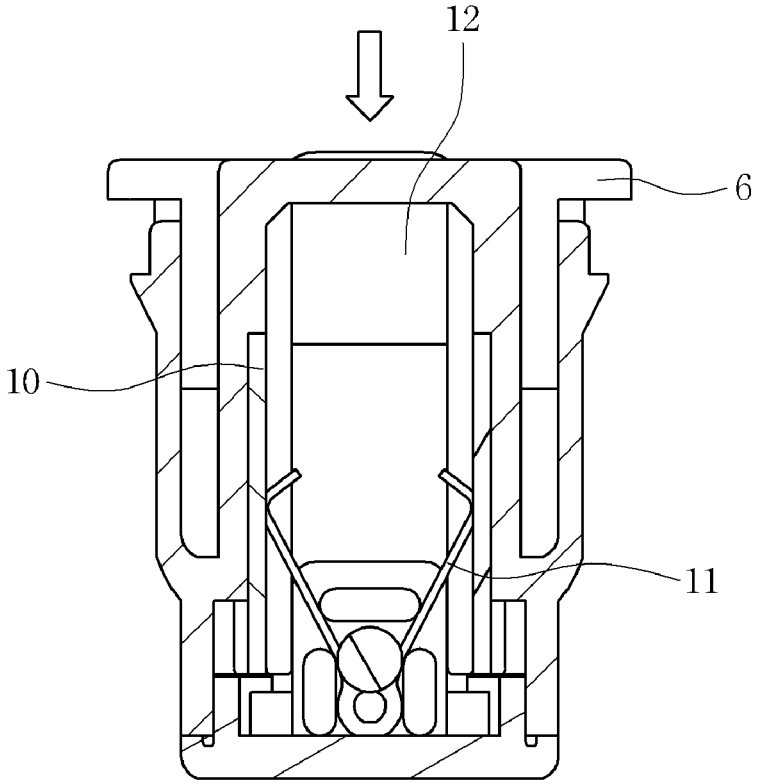

FIG. 6A and FIG. 6B are cross-sectional views showing the state in which the seat switch of the present invention is operated when a pressure is applied from above.

Referring to FIG. 6A and FIG. 6B, when an occupant is occupying the seat of the vehicle, the seat switch maintains the "on" state in which the terminal pin 10 acting as the fixed contact and the contact pin 11 acting as the movable contact are electrically connected to each other.

In other words, since the weight of the driver or the like who is occupying the seat is applied to the top of the rod 12, the actuation rod 12 together with the contact pin 11 moves down against the elastic force of the return spring 14 so that the contact pin 11 stays in contact with the inner surface 10*a* of the terminal pin 10.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

What is claimed is:

1. A seat switch assembly comprising:

a pressing plate which has a plurality of guides in a periphery thereof;

a base having an assembly hole in a central portion thereof and a plurality of guide holes to which the plurality of guides are fastened;

a seat switch housing which is fastened to the assembly hole of the base and has a through-hole extending in a top-bottom direction;

an actuation rod which is received inside the through-hole of the switch housing, and moves in the top-bottom direction in response to a pressure transmitted from the pressing plate;

a V-shaped contact pin which is fixed to a fixing guide of a fixing portion of the actuation rod;

a terminal pin, wherein one portion of the terminal pin is buried inside the seat switch housing and the other portion of the terminal pin is exposed to an outside;

a return spring which is received in a lower portion of the actuation rod inside the through-hole of the seat switch housing; and a cover which closes a lower portion of the through-hole of the seat switch housing, wherein an inner surface of the through-hole of the seat switch housing and an inner surface of the terminal pin buried inside the seat switch housing are positioned coplanar without a stepped portion.

2. The seat switch assembly according to claim 1, wherein an anti-dislodgment protrusion for preventing the contact pin from being dislodged is coupled to one end of the fixed guide.

3. The seat switch assembly according to claim 1, wherein an upper guide is formed on a fixing portion of the actuation rod, the upper guide maintaining elasticity of the contact pin by limiting a range to which the contact pin is shrunk inward.

4. The seat switch assembly according to claim 1, wherein side guides are formed on a fixing portion of the actuation rod, the side guides being positioned on both sides of the fixing guide to limit a range to which the contact pin is spread outward.

5. The seat switch assembly according to claim 1, wherein a lower guide is formed on a fixing portion of the actuation rod, the lower guide being posited in a lower portion of the fixing guide to fix the contact pin so that the contact pin is uplifted along with the actuation rod when the actuation rod moves upward.

6. The seat switch assembly according to claim 1, wherein the terminal pin is machined from brass.

7. The seat switch assembly according to claim 6, wherein a composition of the brass comprises, by weight percent, 0.3 to 0.5 of Mn, 0.6 to 0.8 of Si, 0.5 to 1.0 of Sn, 0.5 to 0.8 of Be, 38 to 40 of Zn, and the balance Cu.

8. The seat switch assembly according to claim 1, wherein the contact pin is machined from phosphor bronze.

9. The seat switch assembly according to claim 8, wherein a composition of the phosphor bronze comprises, by weight percent, 5.0 to 9.0 of Sn, 0.1 to 0.5 of P, 0.001 to 0.1 of Ce, 0.001 to 0.1 of La, and the balance Cu.

10. The seat switch assembly according to claim 1, wherein a hardness of the terminal pin ranges from 125 to 140 (Hv), and a hardness of the contact pin ranges from 165 to 185 (Hv).

* * * * *